US006763981B2

(12) United States Patent
Peretz et al.

(10) Patent No.: US 6,763,981 B2
(45) Date of Patent: Jul. 20, 2004

(54) WELL BLOCK FOR METALLURGICAL VESSEL

(75) Inventors: Israel Peretz, Pittsburgh, PA (US); Timothy A. Leitzel, Elizabeth, PA (US)

(73) Assignee: North American Refractories Co., Pittsburgh, PA (US)

( * ) Notice: Subject to any disclaimer, the term of this patent is extended or adjusted under 35 U.S.C. 154(b) by 0 days.

(21) Appl. No.: 10/134,836

(22) Filed: Apr. 29, 2002

(65) Prior Publication Data

US 2003/0201588 A1 Oct. 30, 2003

(Under 37 CFR 1.47)

(51) Int. Cl.[7] ..... B22D 41/08
(52) U.S. Cl. ..... 222/594; 222/591; 222/597
(58) Field of Search ..... 222/591, 594, 222/597

(56) References Cited

U.S. PATENT DOCUMENTS

| | | | | |
|---|---|---|---|---|
| 1,135,025 A | | 4/1915 | Klug | |
| 1,403,349 A | | 1/1922 | Shimer | |
| 1,832,873 A | | 11/1931 | Milner | |
| 3,203,689 A | | 8/1965 | Hallowell, Jr. | 266/45 |
| 3,395,831 A | * | 8/1968 | Minteer, Jr. | 222/591 |
| 3,395,840 A | * | 8/1968 | Gardner | 222/594 |
| 3,603,050 A | | 9/1971 | Coleman | 52/249 |
| 3,829,960 A | | 8/1974 | Hubble et al. | 29/527.1 |
| 4,037,762 A | * | 7/1977 | Ruckstuhl | 222/591 |
| 4,268,015 A | | 5/1981 | Lührsen et al. | 266/236 |
| 4,390,170 A | | 6/1983 | Schaefer, IV et al. | 266/272 |
| 4,725,045 A | | 2/1988 | Cutre et al. | 266/230 |
| 5,321,875 A | | 6/1994 | Hoffman et al. | 29/271 |
| 5,335,896 A | | 8/1994 | Idstein et al. | 266/236 |
| RE35,597 E | | 8/1997 | Vassilicos | 266/230 |
| 5,718,415 A | | 2/1998 | Dainton | 266/45 |
| 5,820,815 A | | 10/1998 | George | 266/45 |
| 5,849,245 A | * | 12/1998 | Egashira et al. | 222/594 |

* cited by examiner

*Primary Examiner*—Scott Kastler
(74) *Attorney, Agent, or Firm*—Kusner & Jaffe

(57) ABSTRACT

A well block for use in a refractory lining in a metallurgical vessel for holding molten metal. The well block is comprised of a body formed of a refractory material. The body has a top surface, a bottom surface, an inner surface defining a bore that extends through the body from the top surface to the bottom surface, and a double-curved outer surface having at least one peak or valley formed thereon.

18 Claims, 1 Drawing Sheet

WELL BLOCK FOR METALLURGICAL VESSEL

FIELD OF THE INVENTION

The present invention relates to refractory components, and more particularly to well blocks and pocket blocks for use in metallurgical vessels for conveying molten metals.

BACKGROUND OF THE INVENTION

The handling of high-temperature liquids, such as molten steel, requires special materials and techniques. Ladles used for handling molten steel are comprised of an outer metallic shell that is lined with a refractory material. The inner surface of the metallic shell is typically lined with one or more layers of a refractory brick that can withstand extremely high temperatures and harsh, abrasive conditions. A "well block" is disposed within the refractory lining of the metallurgical vessel. A well block is a refractory component having a bore therethrough to allow molten metal within the vessel to exit therefrom. The well block must be fixedly secured within the refractory lining to prevent the block from separating, i.e., floating, from the refractory lining on the bottom of the vessel during operation. To this end, it has been known to form well blocks having a step at the bottom thereof or to taper the well block from top to bottom to prevent the aforementioned floating or separation. It is also important that the well block be designed to retard penetration of molten metal along the interface between the well block and the refractory lining.

Steel ladles of the type heretofore described have a limited service life, after which the ladle must be relined. Advances in refractory brick technology have increased the service life of the refractory linings to where a brick lining may undergo 80 to 120 "heats," i.e., use, before it is necessary to reline the ladle. However, conventional well blocks cannot withstand the repeated heating cycles of such a level of many ladle bricks now available. In this respect, conventional well blocks are formed by casting a refractory material, or by an air-ramming process. Air-rammed well blocks have a limited service life because it is difficult to obtain a block with good density by this process. A cast well block provides substantially better performance than an air-rammed block, but even a cast well block cannot provide the service life of newer refractory linings. As a result, multiple well block changes are typically required during the life of the refractory lining.

The present invention provides a well block having a service life that exceeds those of cast or rammed well blocks, and provides a well block that is designed to lock into a refractory lining and reduce metal penetration along the block-refractory lining interface.

SUMMARY OF THE INVENTION

In accordance with a preferred embodiment of the present invention, there is provided a well block for use in a refractory lining in a metallurgical vessel for holding molten metal. The well block is comprised of a body formed of a refractory material. The body has a top surface, a bottom surface, an inner surface defining a bore that extends through the body from the top surface to the bottom surface, and a double-curved outer surface having at least one peak or valley formed thereon.

In accordance with another aspect of the present invention, there is provided an isopressed well block for use in a refractory lining in a metallurgical vessel for holding molten metal. The well block has a body having a top surface, a bottom surface, an inner surface defining a bore that extends through the body from the top surface to the bottom surface. The refractory material is comprised of 5 to 95% by weight of a material selected from the group consisting of alumina in the form of tabular alumina, white fused alumina, brown fused alumina, bauxite or combinations of those materials, magnesium oxide (MgO), silica ($SiO_2$), zirconium oxide ($ZrO_2$), mullite ($3\ Al_2O_3.2\ SiO_2$) and combinations thereof, 1 to 25% by weight carbon, and 0 to 15% of an antioxidant.

It is an object of the present invention to provide a well block for use in a refractory lining in a metallurgical vessel.

It is another object of the present invention to provide a well block as described above that has a service life exceeding conventional, cast or air-rammed well blocks.

It is another object of the present invention to provide a well block as described above that is isopressed.

It is another object of the present invention to provide a well block as described above that is less susceptible to separation from the refractory lining during use.

Another object of the present invention is to provide a well block as described above that minimizes penetration of molten metal along the refractory block-refractory lining interface.

Another object of the present invention is to provide a well block as described above having a bore diameter that minimizes turbulence and reduces wear from the flow of molten metal therethrough.

These and other objects will become apparent from the following description of a preferred embodiment and invention, taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
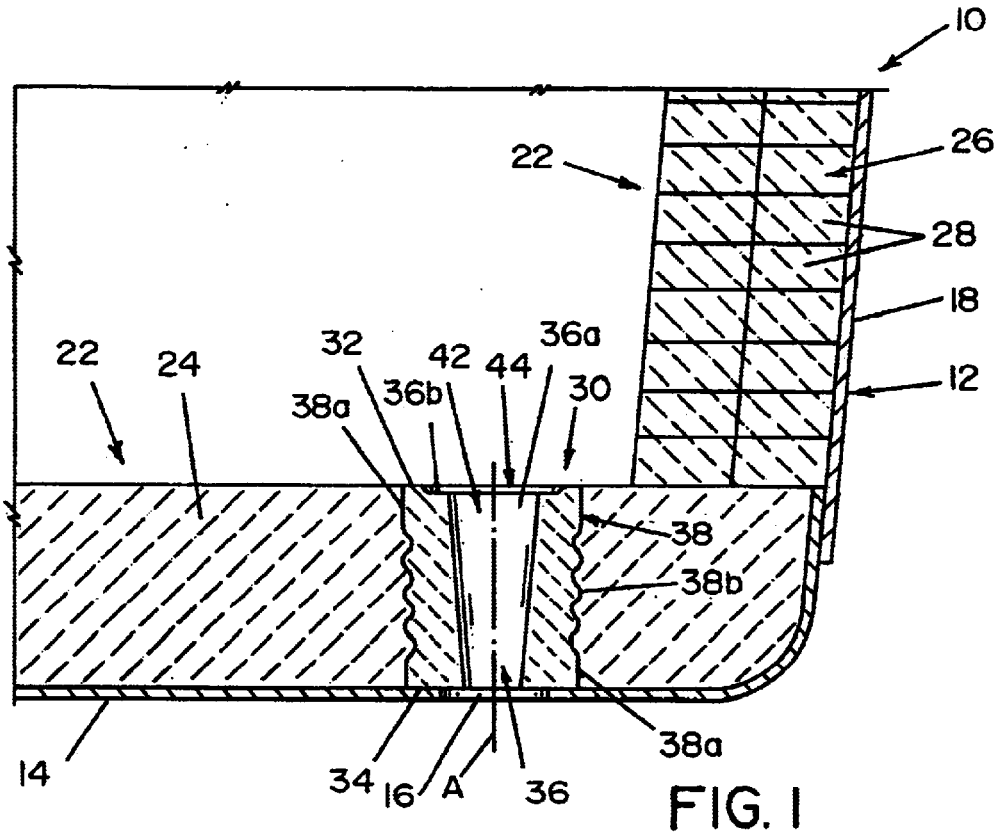
FIG. 1 is a sectional view of the bottom portion of a steel ladle, showing a well block illustrating a preferred embodiment of the present invention.

Referring now to the drawings wherein the showings are for the purpose of illustrating a preferred embodiment of the invention only, and not for the purpose of limiting same, the present invention relates generally to a refractory well block for use in a metallurgical vessel used in handling molten metal, and will be described with particular reference thereto. It would be appreciated from a further reading of the specification, that the invention is not limited to a particular design or use, but may find advantageous application for use in metallurgical vessels handling many types of molten metal.

Figure 2:
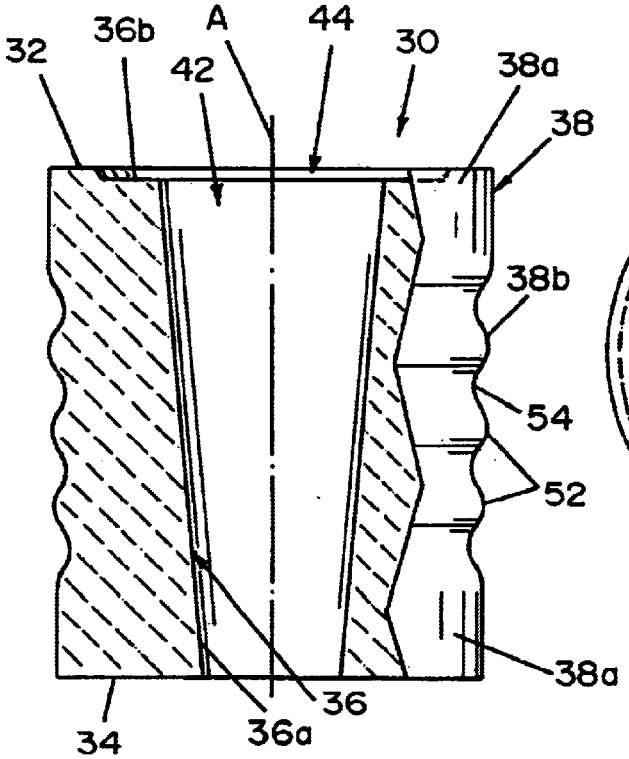
FIG. 2 is a partially sectioned, elevational view of the well block shown in FIG. 1.
Figure 3:
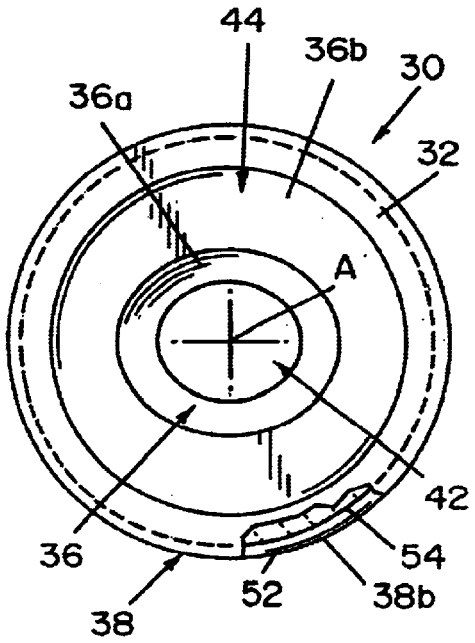
FIG. 3 is a partially sectioned, top plan view of the well block shown in FIG. 1.

FIG. 1 shows the bottom end of a conventional steel ladle 10 having an outer metallic shell 12 and an inner refractory lining 22. Outer metallic shell 12 is comprised of a cup-shaped bottom 14 having an opening 16 therein, and a slightly conical side wall 18. Refractory lining 22 is comprised of a bottom refractory lining 24 and a side refractory lining 26. In the embodiment shown, bottom refractory lining 24 is a cast monolith. Side refractory lining 26 is comprise of two layers of refractory brick 28 that rest upon bottom refractory lining 24. Disposed within bottom refractory lining 24 in registry with opening 16 is a well block 30, best illustrated in FIGS. 2 and 3.

Well block 30 is generally tubular in shape and has a top surface 32, a bottom surface 34, an inner surface 36 and an outer surface 38. In the embodiment shown, top and bottom surfaces 32, 34 are flat and parallel to each other. Inner surface 36 is comprised of a first surface portion 36*a* that defines a bore 42 that extends through well block 30. Bore 42 is tapered from top surface 32 to bottom surface 34. Bore 42 may be circular in cross-section, but in accordance with one aspect of the present, preferably has an oval or elliptical cross-section to facilitate smooth laminar flow of molten metal therethrough. A second surface portion 36*b* defines a shallow, annular recess 44 at the top end of well block 30.

In accordance with one aspect of the present invention, outer surface 38 is comprised of first "ruled surface portions" 38*a*-that are disposed at the ends of well block 30. As used herein, the term "ruled surface" shall refer to a surface generated by a straight line. Disposed between ruled surface portion 38*a* is a double-curved surface portion 38*b*. As used herein the term "double curved surface portion" shall refer to a surface that has no straight line elements and that is curved in every direction. In the embodiment shown, ruled surface portion 38*a* and double curved surface portion 38*b* are surfaces of rotation defined by rotation of a straight line and a curved line, respectively, about an axis designated "A." In this respect, ruled surface portions 38*a* are cylindrical in shape, and well block 30, as a whole, has a generally cylindrical configuration. Block 30 is generally symmetrical about axis A. As will be appreciated from a further reading of the specification, surface portions 38*a*, 38*b* may also be generated by revolving straight and curved lines about a non-circular, closed path, such as by way of example and not limitation, an elliptical path and an oval path. In the embodiment shown, double curved surface portion 38*b* is a surface revolution generated by revolving a smooth, curved, serpentine line having peaks and valley about axis A, wherein a plurality of annular ridges and recesses that extend around well block 30 are formed. Ruled surface portions 38*a* join double curved surface portion 38*b* without any sharp corners. In other words, outer surface 38*b* has a continuous, smooth profile from top surface 32 to bottom surface 34.

A well block 30 of the type heretofore described may be formed of a conventional, high temperature refractory material typically used in such applications and find advantageous application in a steel ladle. However, in accordance with another aspect of the present invention, refractory block 30 is formed by an isopressing process. Isopressing refractory block 30 facilitates use of certain refractory materials that do not lend themselves to casting or air-ramming techniques. Moreover, isopressing block 30 provides a denser structure than could be obtained by casting or air-ramming.

Broadly stated, an isopressed refractory block 30 according to the present invention is comprised of:

5 to 95% by weight of a refractory aggregate;

1 to 25% by weight carbon;

0 to 15% by weight of an antioxidant; and a resin binder.

By way of example, and not limitation, the refractory aggregate may be formed of alumina in the form of tabular alumina, white fused alumina, brown fused alumina, bauxite or combinations of those materials, magnesium oxide (MgO), silica ($SiO_2$), zirconium oxide ($ZrO_2$), mullite ($3\ Al_2O_3.2\ SiO_2$) and combinations thereof. As will be appreciated by those skilled in the art, other types of refractory material may also be used.

The carbon may take the form of graphite. In this respect, isopressing facilitates the use of graphite, which cannot be cast into a well block without the use of high water contents that would result in low density shapes. Additionally, it is appreciated by those skilled in the art that shapes containing carbon such as flake graphite are not easily air-rammed, and that air-rammed shapes containing such materials also have low density.

Conventional antioxidants, such as aluminum, silicon and boron or boron compounds such as boron carbide, are suitable for use in forming block 30.

Resin binders that may be used to form refractory block 30 are epoxies, urethanes, phenolic resins or other thermosetting resins.

It will be appreciated that other materials can be substituted without departing from the spirit of the invention.

In a preferred embodiment, isopressed refractory block 30 is comprised of about 73% alumina, about 16% magnesia, about 4% flake graphite, about 6% antioxidants and carbon filler, along with a phenolic resin binder.

Referring now to use of well block 30, well block 30 is adapted to be placed on cup-shaped bottom 14 of ladle 10 with bore 42 aligned with opening 16. Bottom refractory lining 24 is cast around well block 30, wherein well block 30 is locked into position within bottom refractory lining 24 filling valleys 54. Annular ridges 52 essentially lock the well block within bottom refractory lining 24. Any tendency to move or float from bottom refractory lining 24 is prevented by ridges 52 and recesses 54 interlocking with corresponding ridges and recesses formed by the surrounding refractory forming bottom refractory lining 24. In one respect, corrugated or serpentine shape of double curved surface portion 38*b* reduces the likelihood of molten metal penetrating along the interface between well block 30 and bottom refractory lining 24 as compared to a cylindrical well block in that the curving corrugated surface area of well block 30 creates a longer path for molten metal to penetrate as compared to a straight, cylindrical surface in conventional well blocks. Further, a smooth, contoured outer surface 38 of well block 30 reduces the likelihood of stress fractures occurring at stress concentration points typically found in shelved or stepped well blocks.

Still further, isopressing refractory block 30 provides a well block capable of utilizing some refractory materials not suitable for a casting process, and a well block that is denser than could be obtained by a ramming or casting process. The present invention thus provides an isopressed well block 30 that has a service life that exceeds a conventional cast or rammed well block, in that isopressing allows for use of materials (e.g., graphite) not suitable for casting or ramming techniques in a well block that is denser than could be obtained in a casting or ramming process. Moreover, a well block 30 according to the present invention has an outer contour that facilitates locking well block 30 within bottom refractory lining 24 and that reduces the likelihood of metal penetration along the block/lining interface.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, while the outer surface of well block 30 has been described with annular ridges and recesses, any other double curved surfaces may find advantageous application in the present invention. The outer surface of well block 30 may have a plurality of smoothly curved, individual dimples that are randomly spaced along the outer surface thereof. Likewise, ridges may be staggered, serpentine, set at an angle relative to axis A or be intersecting. It is intended that all such modifications and alterations be included insofar as they come within the scope of the invention as claimed or the equivalents thereof.

Having described the invention, the following is claimed:

1. A well block for use in a refractory lining in a metallurgical vessel for holding molten metal, said well block comprised of: a body formed of a refractory material, said body having a top surface, a bottom surface, an inner surface defining a bore that extends through said body form said top surface to said bottom surface, and a double-curved outer surface having a plurality of separate annular ridges and valleys formed thereon that extend around said well block.

2. A well block as defined in claim 1, wherein said double-curved outer surface is a surface defined by revolving a curved surface about an axis through said body.

3. A well block as defined in claim 2, wherein said bore is symmetrical to said axis.

4. A well block as defined in claim 3, wherein said curved surface is a serpentine line that defines said plurality of annular ridges and valleys.

5. A well block as defined in claim 4, wherein said well block is isopressed.

6. A well block as defined in claim 5, wherein said bore tapers inwardly from said top surface to said bottom surface.

7. A well block as defined in claim 6, wherein said bore has a non-circular cross-section.

8. A well block as defined in claim 7, wherein said bore is elliptical in cross-section.

9. A well block as defined in claim 4, wherein said well block is formed from a cast refractory.

10. A well block for use in a refractory lining in a metallurgical vessel for holding molten meta wherein said metallurgical vessel includes a bottom refractory lining, said well block comprised of:

a body formed of a refractory material, said body having a top surface, a bottom surface, and an inner surface defining a bore that extends through said body from said top surface to said bottom surface, and a double-curved outer surface having a plurality of separate annular ridges and valleys formed thereon, wherein said bottom refractory lining is cast around said body.

11. A well block as defined in claim 10, wherein said double-curved outer surface is defined by revolving a curved surface about an axis through said body.

12. A well block as defined in claim 11, wherein said bore is symmetrical to said axis.

13. A well block as defined in claim 12, wherein said curved surface is a serpentine line that defines a plurality of annular ridges and valleys that extend around said block.

14. A well block as defined in claim 13, wherein said well block is isopressed.

15. A well block as defined in claim 14, wherein said bore tapers inwardly from said top su face to said bottom surface.

16. A well block as defined in claim 15, wherein said bore has a non-circular cross-section.

17. A well block as defined in claim 16, wherein said bore is elliptical in cross-section.

18. A well block as defined in claim 13, wherein said well block is formed from a cast refractory.

* * * * *